United States Patent [19]

Crewse

[11] 4,070,947

[45] Jan. 31, 1978

[54] SPRINGLESS IMPACTOR

[75] Inventor: John L. Crewse, Parma Heights, Ohio

[73] Assignee: The Cleveland Vibrator Company, Cleveland, Ohio

[21] Appl. No.: 707,561

[22] Filed: July 22, 1976

Related U.S. Application Data

[63] Continuation-in-part of Ser. No. 561,284, March 24, 1975, abandoned, which is a continuation-in-part of Ser. No. 408,554, Oct. 23, 1973, abandoned.

[51] Int. Cl.[2] ..... F15B 21/02; F15B 15/17; F15B 13/044

[52] U.S. Cl. ..... 91/39; 91/416; 91/459; 91/468; 92/165 R

[58] Field of Search ..... 91/416, 224, 325, 235, 91/275, 317, 39

[56] References Cited

U.S. PATENT DOCUMENTS

| | | | |
|---|---|---|---|
| 3,365,624 | 1/1968 | Komendera | 91/275 |
| 3,376,790 | 4/1968 | Matson | 91/235 |
| 3,401,604 | 9/1968 | Blatt et al. | 91/416 |

*Primary Examiner*—Paul E. Maslousky
*Attorney, Agent, or Firm*—Baldwin, Egan, Walling & Fetzer

[57] ABSTRACT

A springless impact device including a piston-cylinder mechanism having at least one preselected coacting port and passageway operatively connected to a valve pressurized fluid control apparatus which selectively feeds and exhausts pressurized fluid to and from the device in a predetermined manner. There is an area differential between the top and bottom ends of the piston head. The device includes an inverted "U"-shaped seal ring on the piston head which functions as a one-way check valve to effect piston reciprocation in coaction with the area differential on the piston head.

1 Claim, 5 Drawing Figures

SPRINGLESS IMPACTOR

This application is a continuation-in-part of my pending application Ser. No. 561,284, filed Mar. 24, 1975, now abandoned, which was a continuation-in-part of my application Ser. No. 408,554, filed Oct. 23, 1973, now abandoned.

This invention relates to controlled vibration devices, and more particularly to springless impactors.

Piston-cylinder type vibrators or impactors are used quite extensively in many applications where controlled vibrations are required. Reciprocation is produced by feeding and exhausting pressurized fluid to and from the top of the piston, with the return stroke of the piston being effected by a suitable resilient means such as a compressed coiled spring. In such devices, the coiled spring is the weak link in the structure as it is most always the first element to fail. Additionally, such springs form an unnecessary resistance and limit the stroke of the piston. There has long been a need for a springless piston-cylinder type impact or vibrator.

Therefore, it is an object of the invention to provide a piston-cylinder type impactor wherein piston reciprocation is effected without the use of springs or the like.

A further object of the invention is to provide a springless impactor device of the above type that is simple in construction, easy to manufacture, and highly effective in operation.

Briefly, the foregoing objects are accomplished by the provision of a piston-cylinder type impactor containing one port and coacting passageway connected to a fluid control means to effect impactor operation, with the return stroke of the piston being produced by an area differential between the top and bottom ends of the piston head in coaction with a "U"-shaped circumferential seal ring on the piston structured to function as a one-way check valve to feed (but not exhaust) pressurized fluid to the bottom end of the piston head. The valve fluid control apparatus functions to supply and exhaust pressurized fluid to and from the top of the piston only.

More specifically, a pressurized fluid operated springless impactor is provided including an upstanding closed-end cylinder having a top end plate and a bottom end impact plate. The cylinder has a bottom port connecting the lower cylinder interior portion with the atmosphere. A piston is operatively disposed in the cylinder for reciprocation therein. The piston has a piston head with the top end of the head having a larger cross-sectional area than the bottom end thereof. The piston head has a resilient (such as, for example, neoprene) packing seal ring disposed circumferantially therearound and in contact with the cylinder inner longitudinal wall. Coacting fluid control timer means for feeding and exhausting pressurized fluid to and from the top interior portion of the cylinder between the piston head top end and the adjacent top end of the cylinder is provided. The seal ring is structured to function as a one-way check valve providing limited flow of pressurized fluid interiorly of the cylinder in one direction from the piston head top end, past the side of the piston head (and past the seal ring) to the bottom end of the piston head to effect piston impactor reciprocation against the impact plate when the fluid control means alternately feeds and exhausts pressurized fluid to and from the top interior portion of the cylinder. The seal ring is U-shaped in transverse section and is positioned circumferentially on the piston head in inverted "U" position to form a one-way fluid check valve.

The cylinder has a side air port connected to the fluid control means for feeding and exhausting pressurized fluid to the bottom side of the piston head to effect preselected controlled reciprocation of the piston. Accordingly, higher intensity impacts thus may be achieved.

The valve control apparatus is conventional and can be programmed to effect an almost infinite range of timed impact sequences in the device. The valve control apparatus can also control, within predetermined ranges, the magnitude of the impacts and vibrations effected by the device.

Other objects and advantages of the invention will be apparent from the following description taken in conjunction with the drawings wherein:

FIG. 3 is a diagrammatic showing of the control means; while

Figure 1:
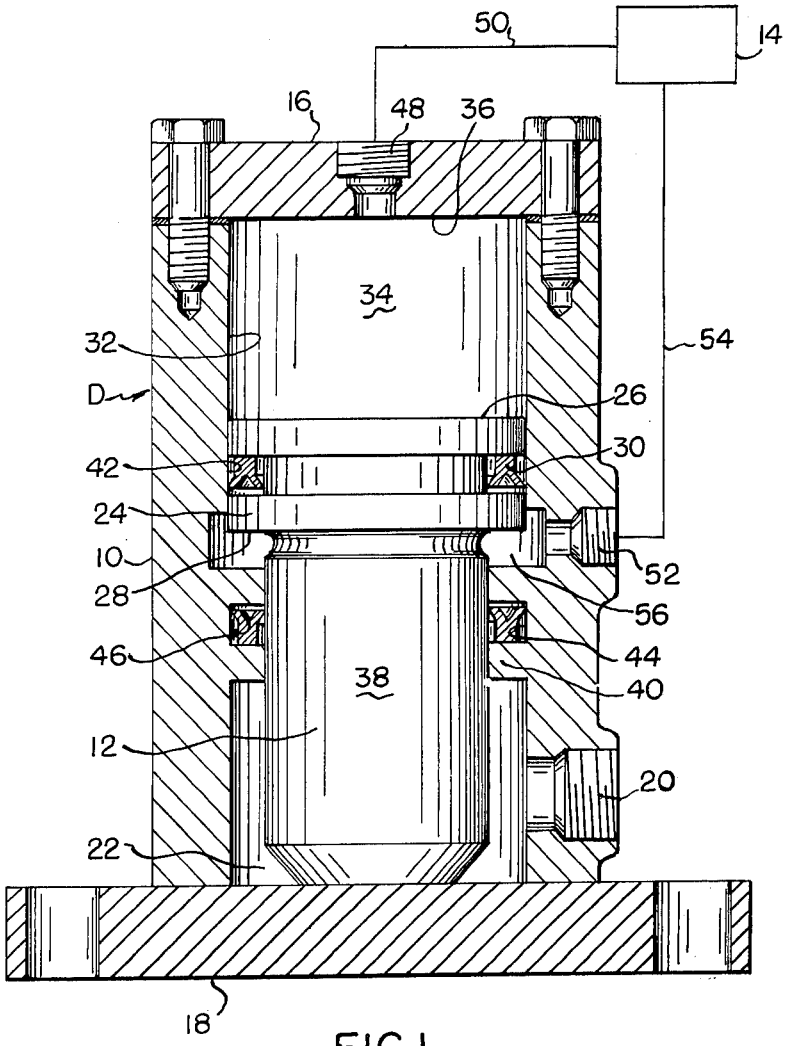
FIG. 1 is a view showing a device therein with the piston shown in its lower reciprocable position.
Figure 2:
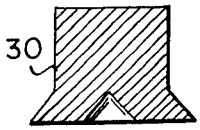
FIG. 2 is an enlarged cross-sectional view of the piston seal ring shown in FIG. 1.

Referring to the drawings, there is shown a springless impactor device D of the invention and including an elongated closed-ended cylinder 10, a piston 12 reciprocably disposed in the cylinder, and a valve fluid control means or apparatus 14 for controlling the flow of pressurized fluid in predetermined sequence to and from the device D as will be hereinafter described in detail.

The valve control apparatus 14 is conventional and will not be described in detail as the same, per se, does not form the invention.

The springless impactor device D includes an upstanding closed-end cylinder 10 having a top end plate 16 and a bottom end impact plate 18. The cylinder has a bottom port 20 connecting the lower cylinder interior portion 22 with the atmosphere. The piston 12 has a piston head 24 with the top end 26 having a larger cross-sectional area than the bottom end or shoulder 28 thereof. The head 24 has a resilient packing seal ring 30 disposed circumferentially therearound and in contact with the cylinder inner longitudinal wall 32. The coacting fluid control means 14 feeds and exhausts pressurized fluid to and from the top interior portion 34 of the cylinder 10 between the piston head top end 26 and the adjacent top end 36 of the cylinder. The seal ring 30 is structured to function as a one-way check valve providing limited flow of pressurized fluid interiorly of the cylinder 10 in one direction (downwardly) from the piston head top end 26 past the side of the piston head (and past the seal ring 30) to the bottom end or shoulder 28 of the piston head 24 to effect piston impactor reciprocation against the impact plate 18 when the fluid control means 14 alternately feeds and exhausts pressurized fluid to and from the top interior portion 34 of the cylinder 10.

Figure 3:
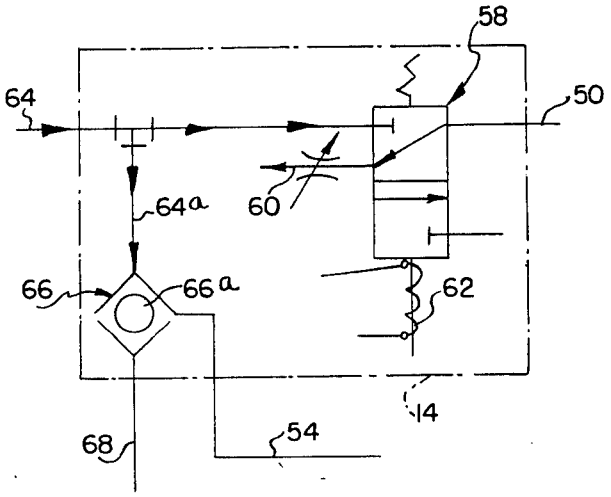

The resilient seal ring 30 is substantially U-shaped in transverse section, as best shown in FIG. 3, and is positioned circumferentially on the piston head 24 in inverted "U" position to function as a one-way fluid check valve.

The piston head 24 is disposed at the upper end of the piston 12 and the lower portion 38 of the piston is of smaller transverse diameter than the piston head, whereby the bottom end of the piston head forms the shoulder 28 of less area than the top end 26 of the piston head. The cylinder 10 has an inwardly extending circumferential guide sleeve portion 40 formed on the inner longitudinal wall 32 of the cylinder and encompassing the piston lower portion 38 to guide the piston longitudinally in the cylinder when it reciprocates therein.

The piston head 24 has a circumferential piston head groove 42 formed around its circumference and the seal ring 30 is disposed in such groove in inverted "U" position.

Likewise, the cylinder guide sleeve portion 40 has a circumferential guide groove 44, and a second seal ring 46 is disposed in such guide sleeve groove in upright "U" position to prevent pressurized fluid from entering into the bottom portion 22 of the cylinder interior.

The cylinder top end plate 16 has a top port 48 therein connected to the fluid control means 14 by the passageway 50. The fluid control means 14 feeds and exhausts pressurized fluid to and from the top interior portion 34 of the cylinder through the top port 48 to reciprocate the piston as aforedescribed.

In the invention, as shown in FIGS. 1 and 3, the fluid port 52 is connected to the fluid control means 14 by the passageway 54 for feeding and exhausting pressurized fluid to the bottom side or shoulder 28 of the piston head 24 of piston 38 to effect preselected controlled reciprocation of the piston. The control 14 has a standard valve 58 (FIG. 4) which is normally in FIG. 3 position connecting line 50 to air exhaust 60, but by solenoid 62 it may be shifted to connect air inlet line 64 to line 50. Air also flows through line **64*a* to quick exhaust valve 66, causing the valve member 66*a* to close exhaust line 68, as in FIG. 4, and permitting air flow to line 54. When the downward travel of piston 38 increases the pressure in line 54, the valve member 66*a* moves upward, as in FIG. 5, closing line 64*a*and opening exhaust line 68. With this structure, higher intensity impacts of the piston 12 against the impact plate 18** may be effected.

In operation, the operating valve or control 14 is activated by a timer, manual operation, or some signal inducing it to shift and cause air to flow to the impactor air inlet or port 48. Air then enters the drive chamber 34 and acts on the large area 26 of the piston 12 driving it down. Some air also pushes the upper "U" packing seal 30 aside and charges the return chamber with pressurized air.

The piston 12 then impacts on the impact plate 18 and the operating valve is shifted causing the air in the drive chamber 34 to be exhausted through the port 48 and through the operating valve control 14. The air that charges the return chamber 56 acts on the shoulder 28 to drive the piston up to the starting position. Thus, the upper "U" packing ring 30 acts as a check valve allowing free flow of air to the return chamber 56 and blocking air flow out of the chamber 56.

The lower "U" packing ring 46 completes the sealing of the return chamber 56. The unit functions regardless of the piston position since the first application of air to the inlet 48 charges the return chamber 56 and moves it into an operating position.

More specifically, the solenoid valve 14 closes, allowing air to flow from the air source through the solenoid valve 14 and to the drive air inlet 48 and into the drive air chamber 34. The pressurized air in the drive air chamber 34 drives the piston down toward impact plate 18 and flows around the piston head 24 and past the "U" packing seal 30 charging the return air chamber 56 with pressurized air.

After piston impact, the solenoid valve 14 shifts, opening the drive air chamber 34 to exhaust through the solenoid valve 14. The air pressure trapped in the return air chamber 56 acts on the shoulder 28 of the piston and causes it to return to the upper or cocked position against the inlet cap 16 ready for another shot of pressurized air.

The piston can be returned to the cocked position by normal operation regardless of its position at the start of operation, because any introduction of air pressure to chamber 34 will charge chamber 56 and "cock" the piston when chamber 34 is exhausted.

Figure 4:
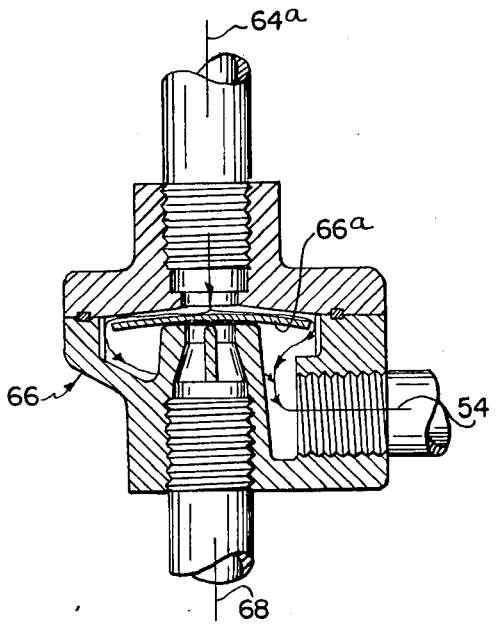
FIGS. 4 and 5 show the actual parts of the element 66, which is shown symbolically in FIG. 3.
Figure 5:
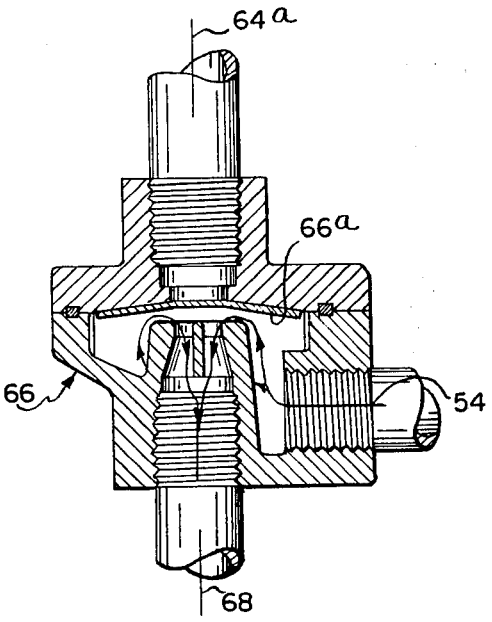

The timer air control 14 is set so that pressurized air is acting with valve 66 in FIG. 4 position, through line 54 on the port 52. This causes pressure to be applied to the shoulder 28 of the piston and holds the piston in a "cocked" position against the inlet cap 16. When the timer energizes the solenoid 62 of control 14, pressure is applied by line 50 through the drive air inlet 48 to the drive air chamber 34. The pressure acting on the large area 16 of the piston causes an unbalance of force on the piston causing it to drive toward impact on the impact plate 18. As the piston moves away from the inlet cap 16, the pressure in the return air chamber 56 and line 54 increases, causing a shift in the exhaust valve 66 blocking the air source and exhausting air from the chamber 56 and line 54, when valve 66 is in the FIG. 5 position.

After impact, pressures in the return air chamber 56 and line 54 are less than the air source pressure in line **64*a* causing the exhaust valve member 66*a* to shift again to the FIG. 4 position, blocking the exhaust port 68 of the valve 66 and again applying pressure around the edges of member 66*a* to the shoulder 28 of the piston through line 54 causing it to return to the cocked position when the solenoid valve 14 is de-energized and exhausts air at 60 from the drive air chamber 34**.

The structure provides greater impact due to the exhaust valve 66 relieving the pressure in the return air chamber 56 and it also provides a more positive return of the piston to a cocked position due to the use of line pressure on the shoulder 28 through the exhaust valve 66 in the control 14.

The unique springless impactor of the invention with its built-in check valve 30 and differential piston areas provides many control and operational posibilities not possible with other available designs.

The terms and expressions which have been used are used as terms of description and not of limitation and there is no intention in the use of such terms and expressions of excluding any equivalents of any of the features shown or described or portions thereof, and it is recognized that various modifications are possible within the scope of the invention claimed.

What is claimed is:

1. A pressurized fluid operated springless impactor comprising, an upstanding closed-end cylinder having a top end plate and a bottom end impact plate, said cylinder having a bottom exhaust port connecting the lower cylinder interior portion with the atmosphere, a piston operatively disposed in said cylinder for reciprocation therein, said piston having a piston head with the top end of the head having a larger cross-sectional area than the bottom end thereof, whereby the bottom end of the piston head forms a shoulder of less area than the top end of the piston head, said cylinder having an inwardly extending circumferential guide sleeve portion formed on the inner longitudinal wall of the cylinder and encompassing a piston lower portion to guide the piston longitudinally in the cylinder when it reciprocates therein, said guide sleeve portion having a resilient packing seal ring disposed circumferentially therearound and in contact with said piston, said seal ring structured to effect at all times a one-way check valve providing flow only toward the piston head top, said head top end having a second resilient packing seal ring disposed circumferentially therearound and in contact with the cylinder inner longitudinal wall, said second seal ring structured to effect at all times a one-way check valve providing limited flow of pressurized fluid interiorly of the cylinder in one direction only from the piston head top end past the side of the piston head to the bottom end of the piston head, the cylinder top end plate having a top port therein, said cylinder having a side fluid port above said guide portion connected to a fluid control timer means for feeding and exhausting pressurized fluid to the bottom side of the piston head to effect preselected control reciprocation of the piston, and said fluid control timer means also feeding and exhausting pressurized fluid to and from the top interior portion of the cylinder between the piston head top end and the adjacent top end of the cylinder, and said coacting fluid control means connected with said side fluid port for exhausting fluid when the fluid pressure beneath said piston head top end exceeds the pressure in said cylinder top end, whereby to effect impactor reciprocation against the impact plate when the fluid control timer means alternately feeds and exhausts pressurized fluid to and from the top interior portion of the cylinder.

* * * * *